United States Patent [19]

Beman

[11] Patent Number: 4,658,443

[45] Date of Patent: Apr. 21, 1987

[54] INVISIBLE SEAM ASSEMBLY AND MODULAR OUTFIT

[76] Inventor: Ellie Beman, 462 Northcroft Rd., Springfield, Pa. 19064

[21] Appl. No.: 847,477

[22] Filed: Apr. 3, 1986

[51] Int. Cl.[4] ..... A41D 1/22

[52] U.S. Cl. ..... 2/105; 2/265

[58] Field of Search ..... 2/265, 275, 70, 107, 2/266; 112/407

[56] References Cited

U.S. PATENT DOCUMENTS

| | | | |
|---|---|---|---|
| 1,565,664 | 7/1923 | Mayer | 2/265 |
| 2,087,925 | 5/1935 | Roseman | 112/407 |
| 2,102,223 | 9/1936 | Roseman | 112/407 |
| 2,148,344 | 2/1938 | Freedman | 2/70 |
| 2,157,011 | 6/1938 | Perry | 2/265 |
| 2,211,100 | 5/1939 | Cohen | 2/70 |
| 2,402,782 | 11/1944 | Schwartz | 2/70 |
| 2,670,470 | 5/1951 | Manheim et al. | 2/70 |
| 2,756,436 | 7/1956 | Heller | 2/266 |
| 2,831,226 | 1/1955 | Moroney | 24/1 |
| 3,008,147 | 11/1961 | Yelton | 2/70 |
| 3,103,050 | 9/1963 | Reitmeier | 2/265 |
| 3,750,605 | 8/1973 | Warburton | 2/265 |

*Primary Examiner*—Doris L. Troutman

*Attorney, Agent, or Firm*—Steele, Gould & Fried

[57] ABSTRACT

An invisible seam assembly for garments and the like, comprising: a non-extensible, but flexible elongated band having a plurality of hooks molded integrally therewith and projecting perpendicularly therefrom, affixable to an inner surface of a garment portion along a seam path; and, an elongated elastic cord affixed to an elongated carrier strip at a plurality of spaced points, defining a plurality of loops enabling the hooks to snugly engage the cord, the carrier strip being affixable to another garment portion. The elasticity of the cord imparts yieldability to the engaged seam and the integrally formed band and hooks impart stability to the engaged seam, whereby the garment portions may be detachably but reliably connected to one another. Such invisible seam assemblies may be incorporated into a modular clothes outfit made from sheer or fine fabrics, for example a wedding gown.

9 Claims, 13 Drawing Figures

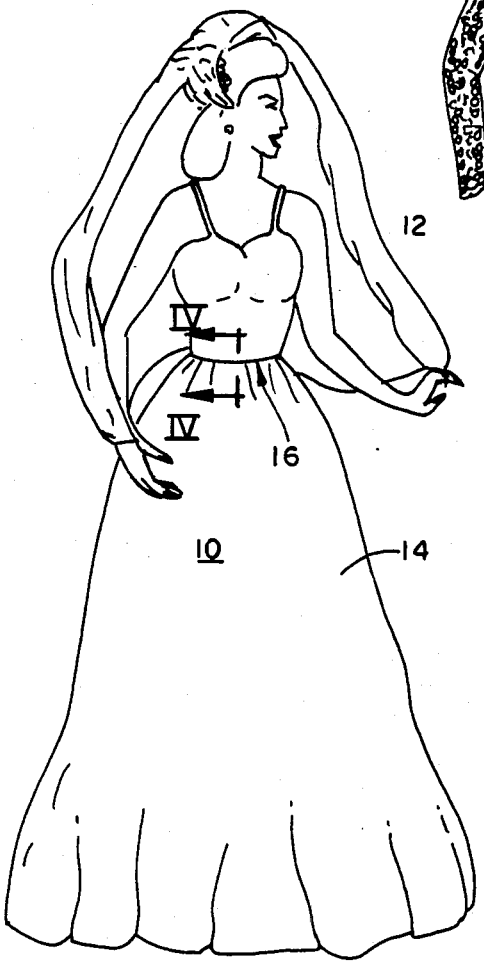
FIG. 1
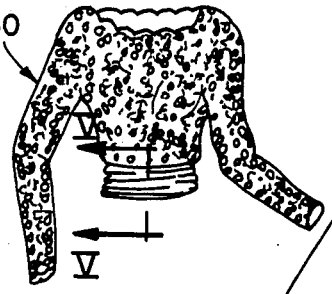
FIG. 2
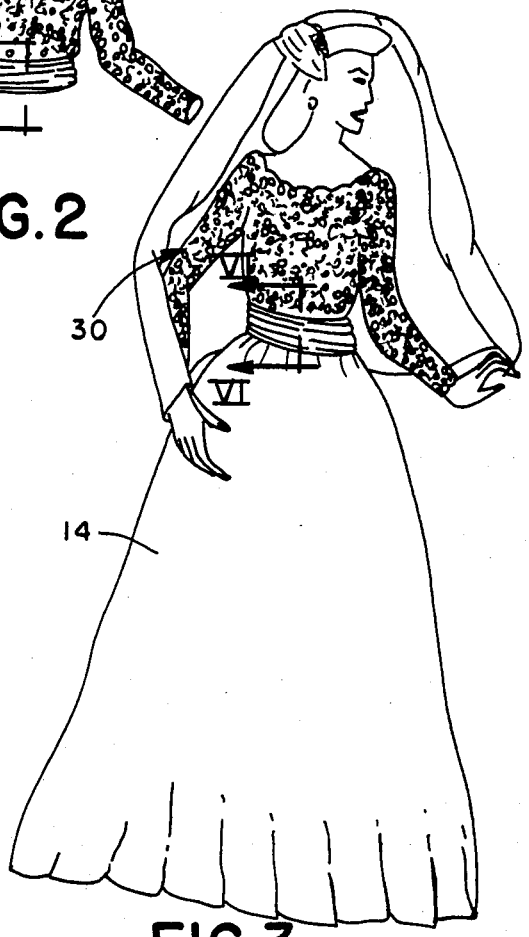
FIG. 3
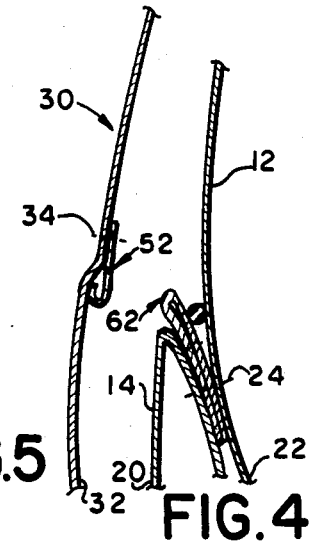
FIG. 5
FIG. 4
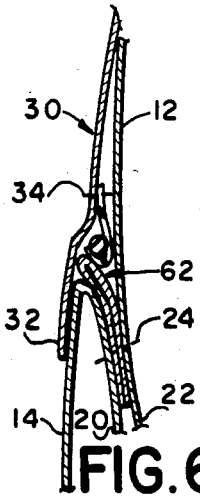
FIG. 6
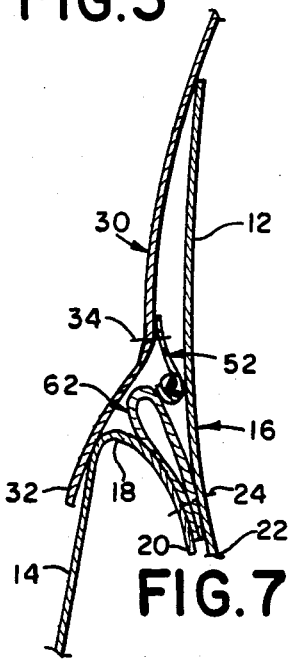
FIG. 7

INVISIBLE SEAM ASSEMBLY AND MODULAR OUTFIT

BACKGROUND OF THE INVENTION

1. Field of the Invention

This invention relates to the field of detachably connectable seam assemblies for garments and the like, and in particular, to improved seam assemblies which can be "invisibly" incorporated into garments and portions thereof, to enable modular clothes outfits to be premanufactured, that is, ready-to-wear. Even more particularly, this invention is related to an invisible seam assembly which can be incorporated into modular outfits with such subtlety as to enable modular, ready-to-wear outfits of sheer and fine fabrics, such as wedding gowns.

2. Statement of Art

The general notion of modular garments is known in the art. A modular garment utilizing zippers is disclosed in U.S. Pat. No. 2,211,100 and a modular garment utilizing cords, loops, buttons and the like is disclosed in U.S. Pat. No. 3,008,147. A modular bullet proof vest utilizing VELCRO fasteners is disclosed in U.S. Pat. No. 4,497,069. Other patent references relating to modular garments are U.S. Pat. Nos. 2,148,344; 2,670,470; and 4,006,495. None of the modular outfits discloses use of the kinds of fine fabrics which are customarily utilized in expensive dresses, wedding gowns and the like, for example lace and organza.

A very wide variety of seam assemblies and fastening systems is disclosed in the following patent references, including U.S. Pat. Nos. 1,565,664; 2,087,925; 2,102,223; 2,157,011; 2,352,564; 2,402,782; 2,756,436; 2,831,226; 3,317,923; 3,490,449; 3,620,180; and, 3,717,908. Generally speaking, the fastening systems disclosed in the foregoing references either require the attachment of a very large number of discrete fastening elements, or alternatively, the use of two carrier strips or the like, to which the plurality of fastening elements are themselves attached. In the first instance, it is frequently more trouble to attach each of the individual fastening elements than to actually sew the seams and produce custom-fitted garments. In the second instance, the resulting seams are bulky, unattractive, and very difficult to "conceal".

Another problem with such systems is exemplified in U.S. Pat. No. 3,620,187. An eye tape for a hook-and-eye (or a stud-and-eye) tape-form fastener comprises the assembly of an elongated strip of pliable sheet material, such as thin sheet plastic. The elongate strip has one or more longitudinal rows of eye-like recesses or openings stamped or otherwise formed thereon for the reception of one or more of the hooks of a companion hook tape (or the studs of a companion stud tape), on a fabric tape or the like arranged so as to provide an open-front envelope or carrier for said plastic eye strip. The plastic eye strip is suitably secured to the fabric tape by sewing, heat sealing, gluing, or the like. A lining strip may be interposed between the plastic eye strip and the underlying portion of the fabric carrier tape. Such a fastening system seems to provide for reliable attachment upon interengagement of all of the hooks or studs into each of the eyes, but the resulting detachable seam is very rigid, very bulky and has no "give" or yieldability. The fastening system is likely to be stronger physically than the fabric to which it is attached, particularly if such fabric were a sheer or fine kind of fabric (it being noted that the use of such sheer or fine fabrics is not suggested therein). Accordingly, any stress on such a seam, caused by body-twisting, arm-lifting or the like, would likely result in some or part of the fastening system being ripped from the fabric to which it was attached.

Accordingly, despite the general knowledge of modular garments or clothes outfits, and despite a wide variety of detachable fastening systems, it has not heretofore been possible to provide a modular garment or clothes outfit made from fine or sheer fabrics with invisible seams enabling detachable connection of the module components to one another.

Another problem with fastening systems according to the prior art is that the fastening systems are invisible or concealed, if at all, only when connected to one another. The fastening systems are such that if an optional garment portion is not desired, its absence will be very unattractively apparent by an exposed portion of the unused fastening system. This is another consequence of the bulky construction of such fastening systems.

Invisible seam assemblies according to this invention overcome all of the problems in the prior art noted above. The seam assemblies are sufficiently delicate to be incorporated into garments made from sheer fabrics, such as lace and organza. At the same time, when such seam assemblies are interengaged, a portion of the seam assembly imparts yieldability to the engaged seam and another portion of the seam assembly imparts stability to the engaged seam. Moreover, the construction detail of the parts of the seam assembly is such that, in one case, the unutilized seam component is concealed on the inner surface of a fabric portion, and in the other instance, the other unutilized seam component appears to be part of an otherwise ordinary seam assembly. Modules may therefore be eliminated altogether without departing even in the slightest from the attractiveness of the composite garment.

Seam assemblies according to this invention overcome all such problems of the prior art.

SUMMARY OF THE INVENTION

It is an object of this invention to provide an invisible seam assembly for garments and the like.

Is is another object of this invention to provide an invisible seam assembly for garments of sheer and fine fabrics.

It is still object of this invention to provide invisible seam assemblies for garments of sheer and fine fabrics, which seam assemblies comprise means imparting yieldability to the engaged seam and means imparting stability to the engaged seam, whereby garment portions may be detachably but reliably connected to one another.

It is yet another object of this invention to provide a modular clothes outfit incorporating the invisible seam assemblies.

It is yet another object of this invention to provide a modular wedding gown.

These and other objects are accomplished by an invisible seam assembly for garments and the like, comprising: non-extensible, but flexible elongated band means having a plurality of hooks formed integrally therewith and projecting perpendicularly therefrom, affixable to an inner surface of a garment portion along a seam path; and, elongated elastic cord means affixed to an elongated carrier strip at a plurality of spaced points, defining a plurality of loops enabling the hooks to snugly engage the cord means, the carrier strip being affixable to another garment portion, the elasticity of the cord means imparting yieldability to the engaged seam and the integrally formed band means imparting stability to the engaged seam, whereby the garment portions may be detachably but reliably connected to one another. The band means is preferably affixed at a distance spaced from an adjacent edge of the garment to define an overhanging portion thereof, the overhanging portion overlying the band means and cord means when interengaged.

These and other objects are also achieved by a modular clothes outfit in combination with at least one such invisible seam assembly. The modular outfit may comprise: a basic inner garment having upper and lower portions joined to one another by a waist seam; one of the carrier strips, with the elastic cord means, disposed in the waist seam and thereby affixed to the basic garment; and, at least two different outer garment portions, each having one of the band means, with the hooks, each of which is selectably attachable to the basic garment. In a presently preferred embodiment, the at least one carrier strip is folded over for double attachment in the waist seam and the elastic cord means is disposed in a notch formed by the fold of the carrier strip and part of the upper portion of the basic garment, the visible portion of the carrier strip having the appearance of a conventional corded seam when nothing is attached thereto. In a modular wedding gown, the upper portion of the basic inner garment is an inner bodice and the lower portion is a skirt. The outer garment portions may be selectably attachable outer bodices. One of the elongated band means may be affixed to the inner surface of each outer bodice, at a distance spaced from the lower edge thereof. The outer bodice would be connected to the basic inner garment about the waist, by means of the invisible seam assembly.

Other objects of this invention will become apparent to those skilled in the art upon consideration of the following detailed description of the preferred embodiments, as shown in the accompanying drawings.

BRIEF DESCRIPTION OF THE DRAWINGS

There are shown in the drawings forms which are presently preferred; being understood, however, that the invention is not limited to the precise arrangements and instrumentalities shown.

FIG. 1 is a front perspective view of a first garment portion of a modular clothes outfit according to this invention;

FIG. 2 is a front perspective view of another garment portion of a modular clothes outfit;

FIG. 3 is a front perspective view of a modular clothes outfit comprising the garment portions shown in FIGS. 1 and 2;

FIG. 4 is a section view, in enlarged scale, taken along the line IV—IV in FIG. 1;

FIG. 5 is a section view, in enlarged scale, taken along the line V—V in FIG. 2;

FIG. 6 is a section view, in enlarged scale, taken along the line VI—VI in FIG. 3;

FIG. 7 is a view, further enlarged, of the interengaged seam assembly shown in FIG. 6, but "spread apart" to clarify construction detail;

DETAILED DESCRIPTION OF THE PREFERRED EMBODIMENTS

Figure 8:
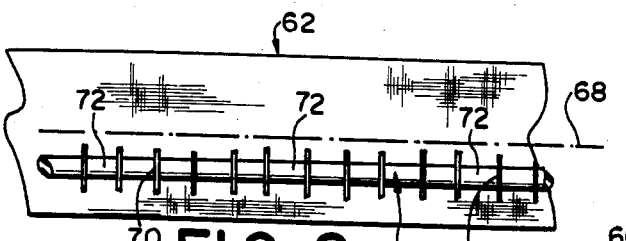
FIGS. 8 and 9 sequentially illustrate formation of the elongated carrier strip and elongated elastic cord means affixed thereto.

Various parts or modules of a composite modular garment or clothes outfit according to this invention are shown in FIGS. 1–3 and 11–12. Insofar as a primary object of this invention is to provide for modular wedding gowns, the modules shown in the drawings are appropriate for selectable interconnection in order to form a wedding gown. Of course, even though wedding gowns are usually recognizable as such, the gown becomes a wedding gown by intention of the wearer. Nevertheless, insofar as a wedding gown represents that garment which, more than any other, is most likely to be custom fitted and manufactured, and worn only once, it is a most appropriate example for the manner in which invisible seam assemblies according to this invention may be utilized to render such normally expensive gowns so inexpensive as to qualify as ready-to-wear, without sacrificing elegance and beauty, even to the slightest degree.

FIG. 1 shows a basic inner garment 10 having an upper portion 12 and lower portion 14 joined to one another by a waist seam 16. The upper portion 12 constitutes an inner bodice and the lower portion 14 constitutes a skirt. Any one of a number of outer bodices 30 and 30', as shown for example in FIGS. 2 and 11, can be selectably attached to the basic garment 10. FIG. 3 illustrates the inner garment 10 in conjunction with outer bodice 30 as shown in FIG. 2. In accordance with the principles of this invention, the waist seam 16 of the basic garment 10 and the lower portion of the waist of the outer bodice 30 are provided with constituent parts or components of an invisible seam assembly according to this invention. It will be appreciated that, notwithstanding the following description, that invisible seam assemblies according to this invention can be used in applications other than wedding gowns.

An invisible seam assembly according to this invention is shown in section, and in enlarged scale, in FIGS. 4–7, which correspond to the section lines of FIGS. 1–3. An invisible seam assembly according to this invention is also illustrated diagrammatically in FIGS. 8–10. Such an invisible seam assembly for garments and the like comprises two principal constituent parts. The first constituent part is a non-extensible, but flexible elongated band means 52. Band means 52 comprises an elongated rib member 54 having a plurality of hooks 56 preferably formed integrally therewith and projecting perpendicularly therefrom. The band means 52 is preferably integrally molded from resilient plastic material. The rib member 54 is provided with a series of holes or openings 58, through which thread stitching and the like can be used to affix the band means to an inner surface of a garment. In order that the band means 52 be as inconspicuous as possible, it is preferred that the width of the rib member be not more than approximately one-eighth inch (½") and the projecting portion of the hooks 56 project by not more than approximately three-sixteenths of an inch (3/16"). The hooks 56 are preferably slightly less than approximately one-fourth inch (¼") wide and are preferably spaced at approximately one inch (1") intervals.

Figure 9:
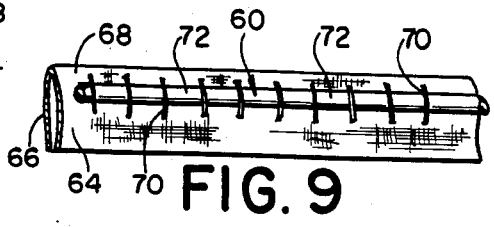
Figure 10:
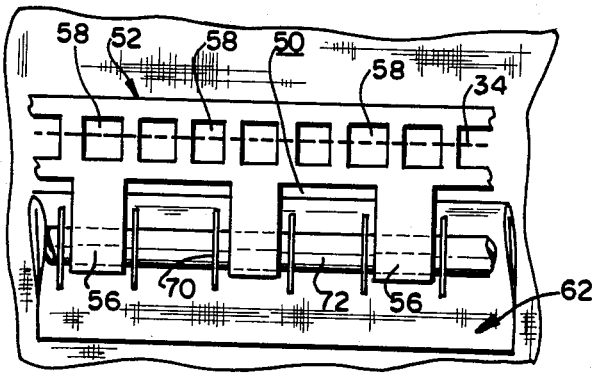
FIG. 10 is a diagrammatic illustration of an engaged, invisible seam assembly as shown in FIGS. 6 and 7.

With reference to FIGS. 8 and 9, the second constituent part comprises an elongated elastic cord means 60 affixed to an elongated carrier strip 62 at a plurality of spaced points by stitches 70, which do not form part of a continuous chain stitch or the like. The carrier strip is preferably made from the same material used for the rest of the garment, as sheer as that material may be. This construction defines a plurality of loops 72 between each stitch 70 enabling the hooks 56 to snugly engage the cord means 60. The stitches are preferably spaced at approximately one-fourth inch (¼") intervals. Carrier strip 62 is preferably approximately one inch wide (1"), having a fold line 68 running longitudinally down the center thereof and defining halves 64 and 66. The elastic cord means 60 is affixed to half 64. After the elastic cord means has been so affixed, the carrier strip is folded at fold line 68, so that the surfaces of halves 64 and 66, opposite to the side on which the elastic cord means is affixed, abut one another. It is in this folded condition that the carrier strip is interposed into and made to form part of the waist seam 16 in the basic garment 10 as shown in FIG. 4. All of the dimensions are suggested as illustrative of the inconspicuous nature of the invention. Such dimensions should not be deemed to limit the scope of the invention.

The inner bodice 12 terminates at a lower edge 22. The skirt 14 has an uppermost point at fold 18, which defines an inwardly facing and downwardly depending flap having a lower edge 20. Carrier strip 62 is interposed between the inner bodice 12 and the skirt 14, and held therebetween by continuous stitching 24. The elastic band means is disposed in a notch formed by the fold of the carrier strip and part of the upper portion of the basic garment, the visible portion of the carrier strip therefore having the appearance of a conventional corded seam, when nothing is attached thereto. This component of the seam assembly is so effectively concealed as to be deemed invisible, as its presence cannot be distinguished from a conventional corded seam.

Figure 11:
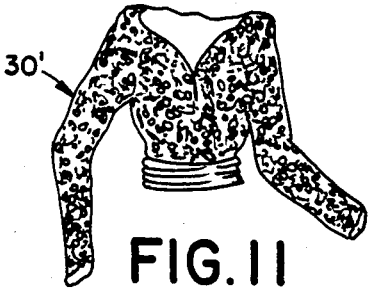
FIG. 11 illustrates a modular alternative to the garment portion shown in FIG. 2.

A band means 52 is affixed to the inner surface of outer bodice 30 as shown in FIG. 5, by continuous stitching 34. Band means 52 is preferably spaced inwardly from the lower edge 32 of outer bodice 30. The band means 52 is so disposed as to have the curl of the hooks facing inwardly, that is, toward the inner surface of the outer bodice. It will be appreciated that the band means 52 is fixed relatively firmly to the outer bodice 30. Even though the resulting flap terminating at edge 32 can be folded away from the band means 52 to enable manipulation thereof, it will be appreciated that band means 52 is positionally stable. By way of contrast, it will be appreciated that, although the carrier strip 62 is firmly fixed and positioned within the waist seam 16 of the inner garment 10, the loops 72 of the elastic cord means still retain a substantial measure of flexibility and yieldability. This yieldability and flexibility provides two advantages. A first advantage is to facilitate interengagement of the hooks and loops, as when the garment portions are attached to one another as shown in FIG. 3, and as illustrated in FIG. 6. It will be appreciated that, notwithstanding the exaggeration of the enlarged scale of FIG. 6, when the garment portions are so interengaged, the lower flap of the outer bodice 30 completely covers the seam assembly, which lays rather flat. FIG. 7 is a view of the interengaged seam assembly as shown in FIG. 6, but "pulled apart" in order to more clearly illustrate the engagement detail. Each hook 56 of the band means 52 snugly engages one of the loops 72 formed between stitches 70 along the elastic cord means 60. The carrier strip 62 is affixed to the inner garment by stitching 24 and the band means 52 is affixed to the outer bodice 30 by stitching 34. Stitching 24 is the very same stitching which would have been utilized to join the upper and lower portions of the basic garment 10 even in the absence of the invisible seam assembly. The stitching 34 by which the band means 52 is attached to the outer bodice is, in and of itself, substantially indiscernible. Morever, as shown by the design of FIGS. 2 and 11, this stitching itself can be easily camouflaged by belt or sash, or even by decorative folds at the waist of the outer bodice. As can be appreciated by a comparison of FIGS. 6 and 7, the elasticity of the cord means imparts yieldability to the engaged seam and the integrally formed band means imparts stability to the engaged seam, whereby the garment portions may be detachably but reliably connected to one another.

Figure 12A:
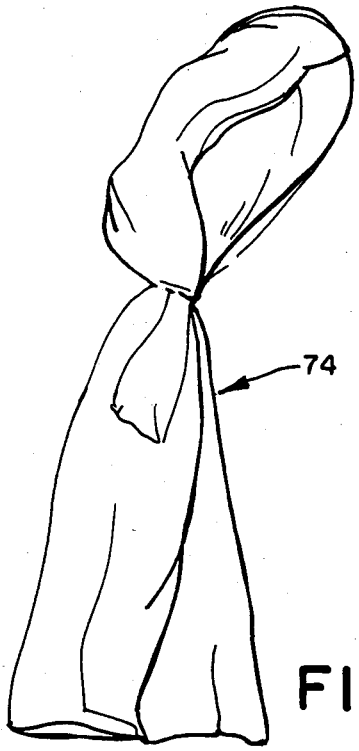
FIGS. 12(*a*) and 12(*b*) illustrate selectably attachable trains for the modular clothes outfit shown in FIG. 3.
Figure 12B:
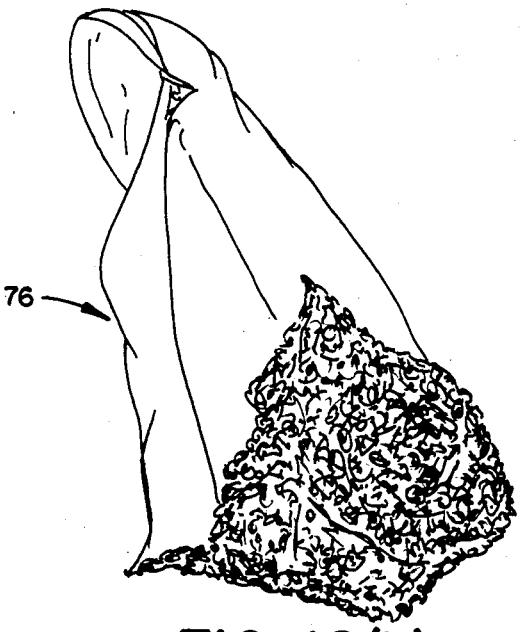

Invisible seam assemblies can be utilized elsewhere, and in connection with wedding gowns for example, can be used for selective attachment of trains 74 and 76, such as those shown respectively in FIG. 12(*a*) and FIG. 12(*b*). In this instance, the skirt is provided with vertical carrier strips 62 sewn into the back seam of the skirt, for example, and each of the trains is provided with a band means 52. After a wedding ceremony, for example, the train can be easily removed and the gown will not be marred in appearance by visible attachment means.

It will be appreciated by those skilled in the art that, in the context of modular clothes outfits, the various modules or constituent parts cannot only differ in design, but in size as well, to accommodate persons of different proportion. Those skilled in the art will also appreciate that invisible seam assemblies according to this invention can be more easily incorporated into many kinds of premanufactured, ready-to-wear garments, as well as those produced by home sewers. Such invisible seam assemblies can even be used in many "permanent" applications.

This invention may be embodied in other specific forms without departing from the spirit or essential attributes thereof. Accordingly, reference should be made to the appended claims, rather than to the foregoing specification, to determine the scope of the invention.

What is claimed is:

1. An invisible seam assembly for garments and the like, comprising:

non-extensible, but flexible elongated band means having a plurality of hooks formed integrally therewith and projecting perpendicularly therefrom, affixable to an inner surface of a garment portion along a seam path; and, elongated elastic cord means affixed to an elongated carrier strip at a plurality of spaced points, defining a plurality of loops enabling the hooks to snugly engage the cord means, the carrier strip being affixable to another garment portion, the elasticity of the cord means imparting yieldability to the engaged seam and the integrally formed band means imparting stability to the engaged seam, whereby the garment portions may be detachably but reliably connected to one another.

2. An invisible seam assembly according to claim 1, wherein the band means is affixed at a distance spaced from an adjacent edge of the garment to define an overhanging portion thereof, the overhanging portion overlying the band means and cord means when interengaged.

3. A modular clothes outfit in combination with at least one invisible seam assembly according to claim 1.

4. A combination according to claim 3, wherein the modular outfit comprises:

a basic inner garment having upper and lower portions joined to one another by a waist seam;

one of the carrier strips, with the elastic cord means, disposed in the waist seam and thereby affixed to the basic garment; and, at least two different outer garment portions, each having one of the band means, with the hooks, each of which is selectably attachable to the basic garment.

5. A combination according to claim 4, wherein the at least one carrier strip is folded over for double attachment in the waist seam and the elastic cord means is disposed in a notch formed by the fold of the carrier strip and part of the upper portion of the basic garment, the visible portion of the carrier strip having the appearance of a conventional corded seam.

6. A combination according to claim 4, further comprising at least one further carrier strip, with the elastic cord means, affixed to the lower portion of the basic garment, for receiving one of at least two further different garment portions.

7. A combination according to claim 6, wherein the outfit comprises a wedding gown.

8. A combination according to claim 7, wherein:

the basic garment comprises an over bodice and a skirt;

the at least two outer garment portions comprise outer bodices; and, the at least two further garment portions comprise trains.

9. A combination according to claim 3, wherein the garment portions and the carrier strip are formed from the same kind of sheer fabric; the band means, the cord means and the carrier strip nevertheless being effectively invisible.

* * * * *